US007434625B2

(12) United States Patent
Adams

(10) Patent No.: US 7,434,625 B2
(45) Date of Patent: Oct. 14, 2008

(54) DOWNHOLE FLAPPER CIRCULATION TOOL

(75) Inventor: Richard Wayne Adams, Houston, TX (US)

(73) Assignee: TIW Corporation, Houston, TX (US)

( * ) Notice: Subject to any disclaimer, the term of this patent is extended or adjusted under 35 U.S.C. 154(b) by 322 days.

(21) Appl. No.: 11/141,840

(22) Filed: Jun. 1, 2005

(65) Prior Publication Data

US 2006/0272824 A1 Dec. 7, 2006

(51) Int. Cl.
*E21B 33/13* (2006.01)

(52) U.S. Cl. ..... 166/373; 166/332.8; 166/386

(58) Field of Classification Search ..... 166/373, 166/332.8, 386
See application file for complete search history.

(56) References Cited

U.S. PATENT DOCUMENTS

| | | | | |
|---|---|---|---|---|
| 3,376,935 | A * | 4/1968 | Baker | 166/317 |
| 4,582,140 | A * | 4/1986 | Barrington | 166/334.2 |
| 4,657,092 | A | 4/1987 | Franks, Jr. | |
| 4,987,841 | A | 1/1991 | Rawson et al. | |
| 5,176,208 | A | 1/1993 | Lalande et al. | |
| 5,335,731 | A | 8/1994 | Riggenberg et al. | |
| 5,402,850 | A | 4/1995 | Lalande et al. | |
| 5,960,881 | A * | 10/1999 | Allamon et al. | 166/291 |
| 6,275,929 | B1 | 8/2001 | Blum et al. | |
| 6,491,103 | B2 * | 12/2002 | Allamon et al. | 166/318 |
| 6,508,309 | B1 * | 1/2003 | French | 166/323 |
| 6,834,726 | B2 * | 12/2004 | Giroux et al. | 166/386 |
| 6,920,930 | B2 * | 7/2005 | Allamon et al. | 166/318 |
| 7,063,156 | B2 * | 6/2006 | Patel et al. | 166/332.8 |
| 2006/0011354 | A1 * | 1/2006 | Logiudice et al. | 166/380 |

* cited by examiner

*Primary Examiner*—William P Neuder
(74) *Attorney, Agent, or Firm*—Browning Bushman P.C.

(57) ABSTRACT

The circulation tool 10 for use downhole in a well includes a housing 22 having one or more bypass ports 52 for circulation between a bore 33 in the housing and an annulus surrounding the housing. Sleeve 50 is axially movable within the housing, and axially spaced seals 36, 56 seal between the sleeve and the housing when the sleeve is in the closed position. A flapper 84 is pivotally mounted to the sleeve, and includes a seat about a central bore 85 in the flapper for engagement with the plug. A stop 40 prevents pivoting of the flapper to an open position until the sleeve has moved axially and the seals seal between the sleeve and the housing.

19 Claims, 3 Drawing Sheets

DOWNHOLE FLAPPER CIRCULATION TOOL

FIELD OF THE INVENTION

The present invention relates to circulation tools of a type used downhole in a well for transferring fluid through ports from a bore within the tool to an annulus surrounding the tool and for subsequently closing the ports to pass fluid through the tool. The circulation tools of the present invention are sometimes referred to as surge tools or surge reduction tools.

BACKGROUND OF THE INVENTION

Downhole circulation tools have been used for decades to selectively flow fluid from the interior of a tubing string or work string to the annulus surrounding the tool. Some tools have the ability to selectively close off circulation ports to subsequently pass fluid down the tubing string or work string. Many of these tools, however, make it difficult or unreliable to pass a cementing plug through the work string after the circulation ports are closed without damaging the plug. Other tools require that the work string be placed on bottom or engage some type of restriction in the well to cycle the tool. Various types of circulation tools have thus been devised for circulating fluid within a tubular string to an annulus, and for subsequently moving a sleeve to close the annulus so that fluid can be passed through the tool.

Prior art circulation tools for selectively closing off flow through a side port in the tool and for subsequently passing cement and cement plugs through the tool include tools with a deformable or expandable seat to allow the ball to pass through the seat and thus through the tool once the sleeve has shifted to close off flow ports in the tool. This type of tool significantly restricts the size of the cement plug which may be reliably passed through the tool, and the deformable seats may damage the plug wiper seals or rubber wafers while passing through the deformable seat. As a consequence, cementing operations are adversely affected since an unknown quantity of cement may pass by the wiper plug after the wiper plug has passed through the tool. Other types of tools employ a flangible disc within the bore of the tool. Pressure builds up on top of the disc to shift a sleeve to close off the circulation ports. A subsequent increase in pressure breaks the flangible disc. Fragments from the disc can be very damaging, however, to a cementing plug which is subsequently passed through the tool. Disc fragments may cut or tear at the wiper plug, thereby damaging the wiper plug.

Another type of tool utilizes a J-type mechanism for moving the sleeve between the open and closed positions. This type of tool or a tubular extending downward from the tool conventionally sits on the bottom of the well so that weight can be applied to manipulate the J-type mechanism.

Other types of surge tools do not provide substantially a full bore opening through the tool, and the restriction in the ID of the tool is thus a significant detriment to the use of the tool.

U.S. Pat. No. 6,275,929 discloses a circulation tool with axially moveable sleeves. Similar tools are disclosed in U.S. Pat. Nos. 6,571,875 and 5,176,208. U.S. Pat. No. 5,402,850 discloses a tool for reverse circulation of fluid in the wellbore. A circulation tool with wash ports is disclosed in U.S. Pat. No. 4,987,841. Another type of circulation tool is disclosed in U.S. Pat. No. 4,657,092. A downhole tool with a combination ball valve and sliding sleeve is disclosed in U.S. Pat. No. 5,335,731.

The disadvantages of the prior art are overcome by the present invention. An improved downhole circulation tool which may be reliably used with cementing operations is subsequently disclosed.

SUMMARY OF THE INVENTION

In one embodiment, a circulation tool for use downhole in a well is suspended in a well from a tubular string. The tool includes a tubular housing including one or more bypass ports for circulation between a bore within the housing and an annulus surrounding the housing. A sleeve is axially movable within the housing and supports axially spaced seals. A pivotally mounted flapper includes a seat about a central bore in the flapper for sealing engagement with a plug. A stop prevents pivoting of the flapper to an open position until the sleeve has moved axially to position the seals above and below the one or more bypass or circulation ports.

In one embodiment, a recess is provided in the housing for allowing movement of the stop to release the flapper to the open position. The tool preferably is substantially full bore, since in the closed position the flapper does not restrict the diameter of the sleeve.

These and further features and advantages of the present invention will become apparent from the following detailed description, wherein reference is made to the figures in the accompanying drawings.

DETAILED DESCRIPTION OF PREFERRED EMBODIMENTS

Figure 1A:
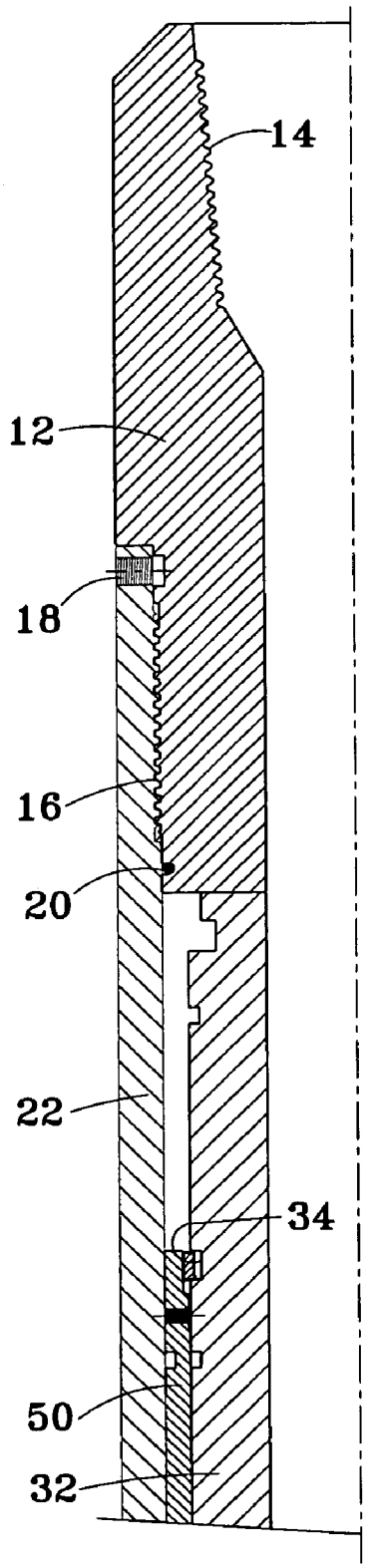
FIG. 1A illustrates an upper portion of a right side circulation tool shown in the run-in position.
Figure 1B:
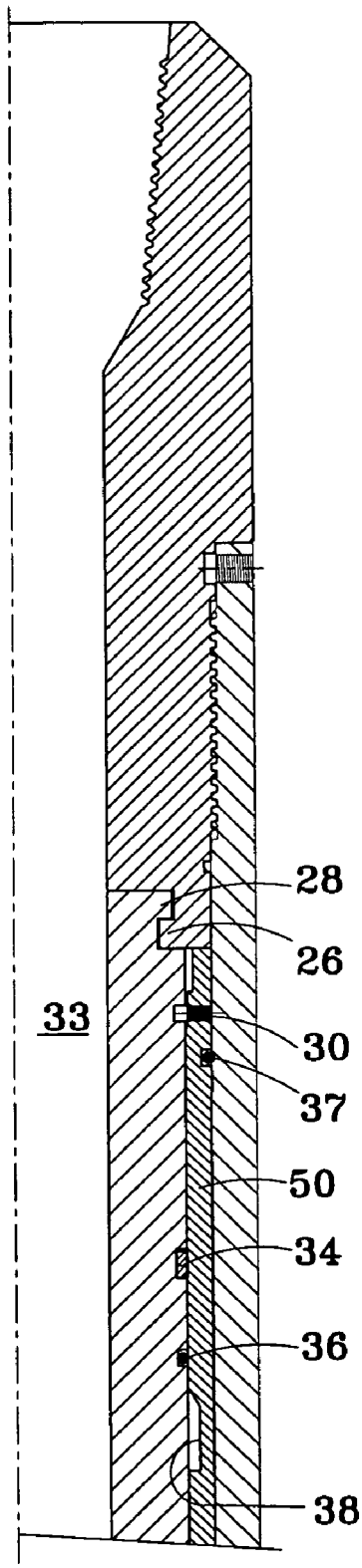
FIG. 1B illustrates the left side of the same tool shifted to close off the circulation ports.

FIGS. 1A, 1B, 1C, and 1D together illustrate a suitable embodiment of a circulation tool 10 according to the present invention. The upper portion of the tool includes a connector 12 having internal threads 14 for threaded engagement with a suitable work string (not shown) and threads 16 for threaded engagement with the sleeve-shaped outer housing 22. A static seal 20 seals between the housing 22 and the connector 12, and set screws 18 prevent unintentional disconnection of the connection 12 from the housing 22.

Figure 1C:
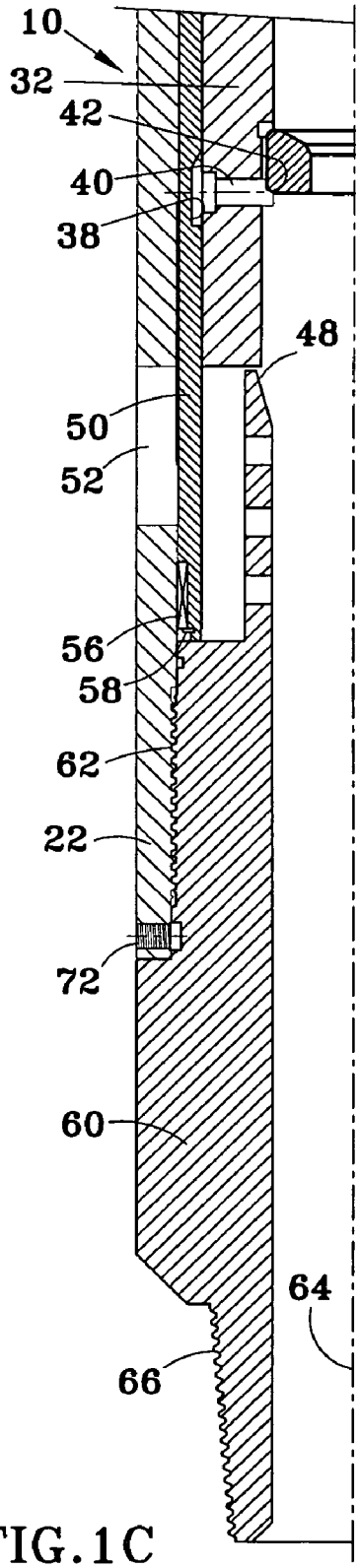
FIG. 1C is a cross-sectional view of a right side of the lower portion of the tool shown in the run-in position.
Figure 1D:
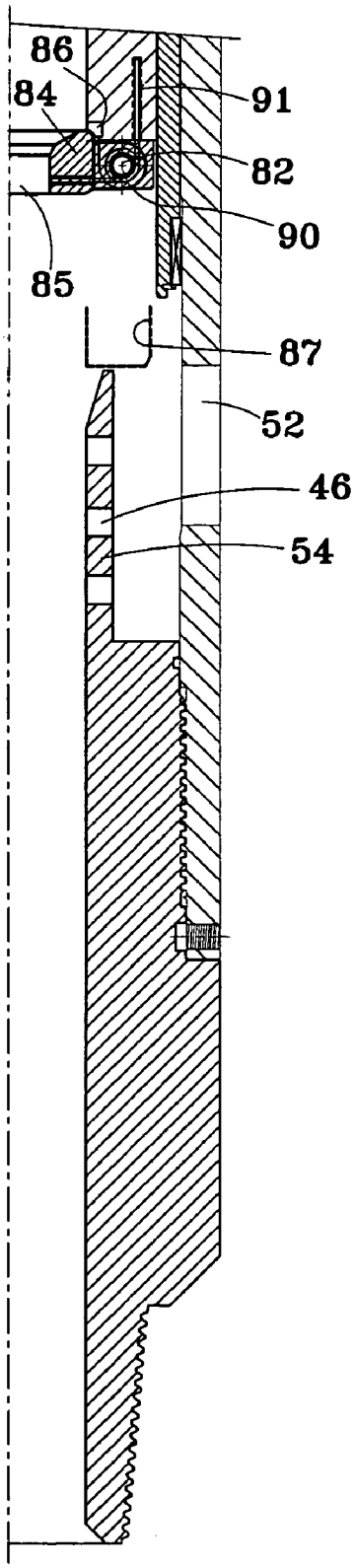
FIG. 1D illustrates the left side of the tool shown in a position to close off the circulation ports.

An inner mandrel 32 includes a bore 33 which has a substantially uniform internal diameter between the upper connector 12 and the lower connector 60. Mandrel 32 has a radially outward extending shoulder or flange 28, and the housing 12 has a radially inward and lower shoulder or flange 26, thereby axially interconnecting the upper connector 12 and the mandrel 32. The flanges 26, 28 are not annular but instead are arc segments that axially connect and disconnect upon rotation of the connector 12 relative to the mandrel 32. Seal 36 seals between the OD of the mandrel 32 and the ID of actuating sleeve 50, which is sandwiched between the mandrel 32 and the outer housing 22. A shear pin or other shear member 30 axially interconnects the mandrel 32 and the sleeve 50, and shears to allow the sleeve 50 to move downward and close off the circulation ports 52 in the housing 22, as shown in FIGS. 1A and 1C. A radially inward groove provided in the mandrel 32 holds snap ring 34 therein. When the sleeve 52 moves down to the position to close off the ports 52, the outwardly biased snap ring pops out, sealing the sleeve in the downward position and locking the tool with the ports 52 closed and the flapper 84 open. The sleeve 50 also includes a radially outwardly extending recess 38, whose purpose is described subsequently.

As shown on FIG. 1C, coil spring 90 with conventional spring legs 91 allow rotation of the flapper 84 about the axis 82, and bias the flapper to the open position. When in the closed position as shown in FIG. 1C, seal 86 is preferably provided for engaging and sealing with both the mandrel 32 and the upper portion of the flapper 84, which has a small diameter bore 85 therein for seating engagement with a suitable plug. When run in the well, lug 40 which is slidably movable relative to the mandrel 32 contains a tapered shoulder 42 for engaging a lower portion of the flapper 84. Sleeve 54 extends upward from lower connector 60, and includes a plurality of through ports 46. Upper tapered end 48 of sleeve 54 engages the lower end surface of mandrel 32. The flow passageways 46 allow fluid to pass from the bore 33 through the sleeve 54. The lower end of the sleeve 54 may be fixed to and may be integral and homogenous with the lower connector 60. The sleeve 50 as shown on the left side of FIG. 1C thus closes off the ports 52, with a lower seal 56 sealing between the sleeve 50 and the outer housing 22, upper seal 36 sealing between the sleeve 50 and the mandrel 32, and upper seal 37 sealing between the sleeve 52 and the outer housing 22. Snap ring 58 may hold the seal 56 in place on the sleeve 50.

As shown by the dashed line 87 in FIG. 1C, the flapper may be pivoted to the open position, and when in the open position the entirety of the flapper 84 is flush with or radially outward of the bore 33.

The lower end of the housing 22 is connected by thread 62 to the lower connector 60, with inadvertent rotation being prevented by set screws 72. External threads 66 on the lower connector 60 are thus adapted for engagement with a tubular extending downward from the circulation tool. The circulation tool 10 has a central axis 64, which is also the axis of the full diameter bore 33 through the tool.

Figure 2:
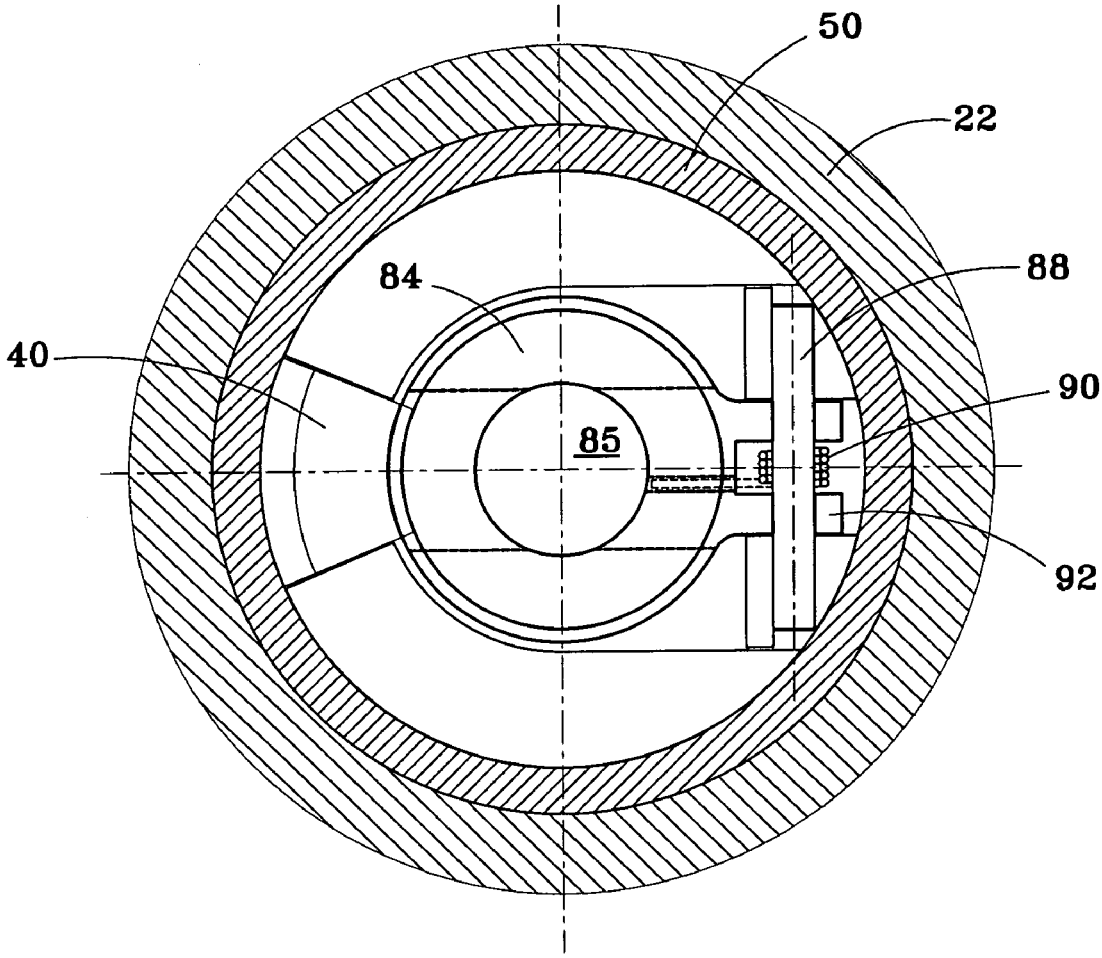
FIG. 2 is a cross-sectional view of the tool shown in FIGS. 1A-1D, illustrating the flapper contained in the run-in position by a lug.

As shown on FIG. 2, the outer housing 22 contains the axially movable sleeve 50 which selectively closes off the circulation ports 52 in the outer housing. A pin or other suitable member 88 is provided for pivoting rotation of the flapper 84 with respect to the mandrel 32, and the coil spring 90 biases the flapper to the open position. The flapper may thus contain a pair of spaced legs 92 for receiving the pivot pin 88 and the coil spring. FIG. 2 also illustrates the lug 40 which prevents pivoting the flapper until the sleeve 50 has moved to the closed position.

During operation of the circulation tool, fluid conventionally travels upward through the full diameter bore 33 and passes outward through the one or more circulation ports 52 to the annulus surrounding the tool. Some fluid may also flow upward through the port 85 in the flapper 84. When it is desired to close off the ports 52, e.g., for a cementing operation, a plug or other ball may be dropped to seat on the flapper 84, thereby raising the pressure above the flapper. This creates a downward force which acts upon the sleeve 50, shearing the pin 30 and moving the sleeve downward to close off the ports 52. When the sleeve is in the fully closed position, the recess 38 as shown in FIG. 1C is in line with the lug 40, thereby allowing the downward force of fluid pressure on the flapper to act on the lug 40 and force the lug radially outward into the slot or recess 38. This action releases the flapper so that it may move to the open position, thus providing a full bore through the circulation tool with the ports 52 closed off by the sleeve 50.

The circulation tool of the present invention is particularly well suited for operations involving the run in of the liner in a well, and the subsequent cementing of the liner by pumping through the work string. When the liner is run in a well, a check valve at the bottom of the liner is conventionally opened so that well fluid enters and passes upward through the liner. The work string or drill pipe at the upper end of the liner thus begins to fill with fluid, and desirably that fluid passes through the circulation tool to the annulus rather than continuing up the drill string or work string. Once the liner is at bottom and positioned for cementing in place, a plug or ball is dropped from the surface and lands on the flapper 84, closing off the hole 85 through the flapper and creating a downward force to move the sleeve 50 to the closed position. As previously explained, the flapper then moves to the open position to provide a full bore flow path through the circulation tool, at which time the ball may be released to either be caught by a conventional ball catcher or passed to the bottom of the string. Flapper plugs or darts may then be passed through the drill string or work string to cement the liner in place, with the darts or plugs passing through the open bore 33 in the circulation tool, which is not restricted and has no sharp edges to damage the plug or wiper.

For the embodiment depicted, the seals between the sleeve 50 and the housing 22 are provided on the sleeve. In other embodiments, the seals could be provided on the housing. In a preferred embodiment, a flapper is provided with a hole therein, so that when the flapper is closed some fluid can pass from below to above the flapper. This construction allows fluid to drain from above to below the flapper in the event the operator needs to pick up on the tubular string before setting the liner in place. Although various types of plugs may be used for seating with the flapper, a preferred plug is a ball. The seat on the flapper is also configured for seating with balls of various sealing diameters, thereby increasing the versatility of the tool.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A circulation tool for use downhole in a well, the circulation tool suspended in the well from a tubular string, the circulation tool comprising:

a tubular housing including one or more bypass ports for circulation between a bore in the housing and an annulus surrounding the housing;

a sleeve axially movable within the housing;

axially spaced seals for sealing between the sleeve and the housing;

a flapper above the one or more ports and including a seat about a central bore in the flapper for engagement with a plug;

the sleeve being axially movable in response to fluid pressure above the flapper when engaged by the plug; and a stop movably responsive to an axial position of the sleeve for preventing pivoting of the flapper to an open position until the sleeve has moved axially and the axially spaced seals seal between the sleeve and the housing.

2. A circulation tool as defined in claim 1, further comprising:

a recess in the sleeve for allowing movement of the stop to release the flapper to the open position.

3. A circulation tool as defined in claim 1, wherein the seat is configured for seating with plugs of various seating diameters.

4. A circulation tool as defined in claim 3, wherein the plug is a bail.

5. A circulation tool as defined in claim 1, further comprising:

a spring for biasing the flapper to the open position.

6. A circulation tool as defined in claim 1, further comprising:

a mandrel radially within the sleeve for supporting the flapper.

7. A circulation tool as defined in claim 6, further comprising:

the flapper in the open position is entirely radially outward of a bore through the mandrel.

8. A circulation tool as defined in claim 1, further comprising:

a seal for sealing between the flapper and the tubing housing when the plug is seated on the flapper.

9. A circulation tool as defined in claim 1, wherein the tubular housing extends between a threaded upper connector and a threaded lower connector.

10. A circulation tool for use downhole in a well, the circulation tool suspended in the well from a tubular string, the circulation tool comprising:

a tubular housing including one or more bypass ports for circulation between a bore in the housing and an annulus surrounding the housing;

a sleeve axially movable within the housing;

axially spaced seals for sealing between the sleeve and the housing;

a flapper above the one or more bypass ports and including a seat about a central bore in the flapper for engagement with a plug;

the sleeve being axially movable in response to fluid pressure above the flapper when engaged by the plug;

a stop movably responsive to an axial position of the sleeve for preventing pivoting of the flapper to an open position until the sleeve has moved axially and the axially spaced seals seal between the sleeve and the housing; and a recess in the sleeve for allowing movement of the stop to release the flapper to the open position.

11. A circulation tool as defined in claim 10, further comprising:

a spring for biasing the flapper to the open position.

12. A circulation tool as defined in claim 10, further comprising:

a mandrel radially within the sleeve for supporting the flapper.

13. A circulation tool as defined in claim 12, further comprising:

a flapper in the open position is entirely radially outward of a bore through the mandrel.

14. A method of circulating fluid in a well, the method comprising:

providing a tubular housing including one or more bypass ports for circulation between a bore in the housing and an annulus surrounding the housing;

providing a sleeve axially movable within the housing in response to fluid pressure;

positioning seals for sealing between the sleeve and the housing;

pivotally mounting a flapper including a seat about a central bore in the flapper for engagement with a plug;

providing a mandrel radially within the sleeve for supporting the flapper; and preventing pivoting of the flapper to an open position until the sleeve has moved axially and the sears seal between the sleeve and the housing.

15. A method as defined in claim 14, further comprising:

providing a recess in the sleeve for allowing movement of a stop to release the flapper to the open position.

16. A method as defined in claim 14, wherein the seat is configured for seating with plugs of various seating diameters.

17. A method as defined in claim 14, further comprising:

biasing the flapper to the open position.

18. A method as defined in claim 14, wherein the flapper is positioned above the one or more ports.

19. A method as defined in claim 14, further comprising:

pumping cement through the tubular housing after the flapper is in the open position and the sleeve is in the closed position.

* * * * *